US009309695B2

(12) United States Patent
Westwinkel et al.

(10) Patent No.: US 9,309,695 B2
(45) Date of Patent: Apr. 12, 2016

(54) ROTATIONAL RANGE MODIFIER FOR LOCKING SYSTEMS

(71) Applicant: WESKO SYSTEMS LIMITED, Mississauga (CA)

(72) Inventors: Florian Westwinkel, Toronto (CA); Tonino Sabelli, Oakville (CA)

(73) Assignee: WESKO SYSTEMS LIMITED, Mississauga, Ontario (CA)

( * ) Notice: Subject to any disclaimer, the term of this patent is extended or adjusted under 35 U.S.C. 154(b) by 285 days.

(21) Appl. No.: 13/837,641

(22) Filed: Mar. 15, 2013

(65) Prior Publication Data

US 2014/0260457 A1 Sep. 18, 2014

(30) Foreign Application Priority Data

Mar. 1, 2013 (CA) ..... 2808036

(51) Int. Cl.

| | |
|---|---|
| ***E05B 35/08*** | (2006.01) |
| ***E05B 27/00*** | (2006.01) |
| ***E05B 29/00*** | (2006.01) |
| ***E05B 9/08*** | (2006.01) |
| ***E05B 17/04*** | (2006.01) |

(52) U.S. Cl.

CPC ..... *E05B 35/08* (2013.01); *E05B 9/086* (2013.01); *E05B 17/04* (2013.01); *E05B 27/0053* (2013.01); *E05B 29/0046* (2013.01); *Y10T 70/7486* (2015.04)

(58) Field of Classification Search

CPC ... E05B 27/005; E05B 27/0053; E05B 29/00; E05B 29/004; E05B 29/0046; E05B 35/08; E05B 35/10

USPC ..... 70/337, 340, 342, 369, 373, 376, 377, 70/392, 421, 492

See application file for complete search history.

(56) References Cited

U.S. PATENT DOCUMENTS

| | | | | |
|---|---|---|---|---|
| 1,954,209 | A | 4/1934 | Jacobi | |
| 1,990,934 | A | 2/1935 | Falk | |
| 2,061,456 | A | 11/1936 | Falk | |
| 2,348,248 | A | 5/1944 | Elliott | |
| 2,460,709 | A | 2/1949 | Navarro | |
| 2,495,387 | A | 1/1950 | Rummins | |
| 2,531,914 | A | 11/1950 | Lager et al. | |
| 3,323,849 | A | 6/1967 | Stark | |
| 3,969,008 | A | 7/1976 | Pergler | |
| 4,094,175 | A * | 6/1978 | Pechner | 70/493 |
| 4,272,138 | A | 6/1981 | Stark | |
| 4,272,975 | A * | 6/1981 | Patriquin | 70/369 |

(Continued)

*Primary Examiner* — Christopher Boswell

(74) *Attorney, Agent, or Firm* — Squire Patton Boggs (US) LLP

(57) ABSTRACT

A locking apparatus includes a fixed housing with a longitudinal elongated bore between two open ends. One end defines an arcuate track with a new rotational displacement range. A pivoting riser extends from a driver to an elongated retainer moving across a locking core configured with a predefined rotational range. A follower on the driver travels within the track. The core and the driver may be connected and inserted via the same open end for rotation within the bore. When the locking core is unlocked and rotated with an operating key, the riser displaces the retainer to retain the core within the housing, while the follower continues to rotate within the track so that the rotational range of the core is changed to the new rotational displacement range. The apparatus may include the core. The apparatus may exclude the core to allow separate installation for combined rotation with the driver.

34 Claims, 9 Drawing Sheets

(56) References Cited

U.S. PATENT DOCUMENTS

| | | | | | |
|---|---|---|---|---|---|
| 4,398,405 | A | | 8/1983 | Patriquin | |
| 4,416,129 | A | | 11/1983 | Thimot | |
| 4,441,767 | A | | 4/1984 | Stark | |
| 4,480,883 | A | | 11/1984 | Young | |
| 4,545,224 | A | | 10/1985 | Zane | |
| 4,624,511 | A | | 11/1986 | Oehme | |
| 4,633,689 | A | | 1/1987 | Wolniak et al. | |
| 4,712,400 | A | | 12/1987 | Steinbach | |
| 4,712,402 | A | * | 12/1987 | Monahan | 70/383 |
| 4,732,433 | A | | 3/1988 | Bruneau | |
| 5,101,649 | A | * | 4/1992 | Duval | 70/369 |
| 5,109,685 | A | * | 5/1992 | Westwinkel | 70/368 |
| 5,235,832 | A | | 8/1993 | Lux et al. | |
| 5,411,327 | A | | 5/1995 | Norton | |
| 5,606,882 | A | | 3/1997 | Larsen et al. | |
| 5,970,762 | A | * | 10/1999 | Myers et al. | 70/492 |
| 6,209,369 | B1 | * | 4/2001 | Freck | 70/375 |
| 6,679,090 | B1 | | 1/2004 | Finch, Jr. | |
| 8,707,746 | B1 | * | 4/2014 | Liu | 70/493 |
| 8,746,022 | B2 | * | 6/2014 | Francois et al. | 70/83 |

* cited by examiner

ROTATIONAL RANGE MODIFIER FOR LOCKING SYSTEMS

FIELD OF THE INVENTION

The invention relates to locking cores which are configured for rotation within a predefined rotational range. The invention may be used in OEM (original equipment manufacture) and with retrofit apparatuses intended to modify existing locking systems used in, by way of example, office equipment, office furniture, cabinets, many other storage structures, and a variety of other movable structures and fixed structures.

BACKGROUND OF THE INVENTION

There are many commonly used locking cores which are being manufactured for new installations, repairs and replacements of other locking cores currently in use in various storage structures. Often, the locking cores are configured with an arcuate recess intended to define a rotational range of the locking core and connected locking components, which is often a 90 degree (or a "quarter turn") rotational range within a corresponding locking system. However, there are many instances that will be apparent to those skilled in the art where upgrades or manufacturing changes are desirable in which the rotational range of the assembled locking system will be changed, such as for example, from a 90 degree (quarter turn) rotational range to a 180 degree (half turn) rotational range system. Of course, other degree changes may also be desirable. In addition, it may be desirable to more easily upgrade or modify locking systems to provide either left-turn or right-turn locking arrangements.

Persons skilled in the art will also appreciate that it may be desirable in some instances to re-use large quantities of existing, in-use locking cores, to avoid the costs and other inconveniences associated with replacing and/or re-keying those locking cores. In those instances, it may be desirable to provide a locking apparatus which provides rotational range modifying capabilities, without requiring a change to the locking cores, or existing locking core configurations. Similar considerations may apply to mass produced locking core designs, using a preferred configuration (for example but not necessarily a quarter turn) rotational range within a variety of locking systems.

U.S. Pat. No. 6,679,090 by Finch is an example of a multi-part locking system with a specialized housing in which a locking core is inserted through the front outwardly facing end of a housing, while an adapter and a shifter are inserted into the housing through an opposite rearwardly facing end, requiring considerable skill and dexterity by the installer to properly align and match the components, all of which must be accomplished within the housing, to ensure proper engagement and operation of the components. After the installation, alignment and engagement of the components within the housing, a specialized backing plate is then fastened to the housing from within an interior space (for example, from within a cabinet), to secure the various components within the housing. In some cases, this may be very difficult to accomplish where subsequent maintenance services, repairs, upgrades or other modifications may be required or desired, particularly where access to the back plate is hindered by other features on a storage structure, or by the surrounding work environment.

Therefore, it would be desirable to provide a system with improved access to a reusable or interchangeable locking core and related components of the locking apparatus included in various locking systems. For example, skilled persons in the art will appreciate that in many instances it will be desirable to allow the locking core and related range adapter components to be accessible and interchangeable via one end of a lock housing, preferably, the front outwardly facing end of a lock housing. Other advantages and adaptations will become readily apparent upon review of this specification, including the following description, drawings and claims.

SUMMARY OF THE INVENTION

The invention includes a locking apparatus comprising a fixed housing with a longitudinal elongated bore extending along a longitudinal axis between two open ends of the housing. One end of the housing defines a track, preferably an arcuate track, to provide a new, modified rotational displacement range for use with a locking core provided with features intended to incorporate a predefined rotational displacement range. In many instances, the configuration of a distal end of such a locking core provides a channel, recess or other feature intended to provide a predetermined range for rotation within a suitably matched receptacle.

In one embodiment of the invention, a riser extends from a driver to engage an elongated retainer moving across a locking core configured with the predefined rotational range. The riser may pivot within a port, such as a cradle, slot or other configuration within the driver.

In one aspect, a follower on the driver travels within the track. The core and the driver may be connected and inserted via the same open end for rotation within the bore. When the locking core is unlocked and rotated with an operating key, the riser displaces the retainer to retain the core within the housing, while the follower continues to rotate within the track so that the rotational range of the core is changed to the new, modified rotational displacement range.

The modified rotational displacement may be selected from the group consisting of: (i) a displacement which is less than the predetermined rotational displacement, (ii) a displacement which is more than the predetermined rotational displacement, (iii) a displacement which is changed from a clockwise to a counterclockwise direction, and (iv) a displacement which is changed from a counterclockwise to a clockwise direction.

In some variations, the apparatus may include the core. In some instances, the apparatus may exclude the core to allow the driver and the core to be installed at different times, after which, the core may be installed for combined synchronized rotation with the driver.

In another embodiment, a locking apparatus is configured for use with a cylindrical locking core with a keyway extending along a common longitudinal axis. In many aspects, the locking apparatus will not include a locking core, but will be adapted for use with existing, reclaimed locking cores and the like. The locking core targeted for use with the apparatus will be configured for rotation within a predefined displacement. The locking apparatus includes:

- a housing to be secured within a storage structure. The housing defines an elongated bore extending along the longitudinal axis between two opposing open ends of the housing.
- an arcuate track at the distal end of the housing. The track defines a second rotational displacement about the longitudinal axis which is different than the predefined displacement defined by the locking core. In many instances, the second rotational displacement will be greater than the predefined rotational displacement.

a driver which is configured to releasably engage the locking core. Preferably, the driver is configured with a profile similar to the locking core so that both components may be inserted into one open end of the elongated bore. The driver and the locking core may be combined for synchronized rotation within the elongated bore. In this embodiment the driver defines a follower for travel within the arcuate track.

and, a riser which moves across the longitudinal axis between a first position and a second position. The riser is in the first position when the locking core is operable with a change key. In the preferred embodiment, the riser is in the first position when the locking core is in the unlocked position. The riser is in the second position when the locking core is operable with an operating key between the locked and unlocked positions of the locking core. The riser engages the locking core to allow the driver to rotate about the horizontal axis within the second rotational displacement.

In another embodiment, a locking apparatus includes the following components:

a cylindrical locking core. The locking core defines a keyway along a longitudinal axis. The core is configured for rotation within a predefined displacement.

a housing which defines a longitudinal elongated bore extending between a proximate open end and a distal open end of the housing. The distal open end of the bore defines a track, preferably forming an arcuate path within the housing. The track defines a modified rotational displacement about the longitudinal axis which is different than the predefined displacement. In this embodiment, the extended rotational displacement extends between a first stop and a second stop defined by the track.

a driver which releasably connects to the locking core. The driver and the locking core may be configured for insertion into a common opening, preferably, the proximate open end of the elongated bore. The driver and the locking core are connected for synchronized rotation within the elongated bore. The driver may comprise a follower configured to travel within the arcuate track.

and, a riser which pivots from the driver and engages a retainer extending from the locking core. The riser and the retainer cooperate for synchronized perpendicular movement across the longitudinal axis, between a first position and a second position. The riser is in the first position when the locking core is operable with a change key and the retainer is adjacent the first stop. The riser is in the second position when the follower is within the modified rotational displacement, while the locking core is operable with an operating key and allowed to rotate about the horizontal axis according to the modified rotational displacement.

In another aspect, the invention provides a locking apparatus for use with an insertable cylindrical locking core. The insertable locking core intended for use with the locking apparatus is configured for rotation about a longitudinal axis according to a predefined rotational displacement. The locking apparatus comprises:

a housing for fixed non-rotating installation within a storage structure. The housing defines a longitudinal elongated bore extending between a proximate open end and a distal open end. The housing defines an arcuate track adjacent the distal open end of the bore. The arcuate track defines a modified rotational displacement for the locking core different than the predefined rotational displacement.

a driver which is configured for releasable engagement with the locking core. The locking core may be inserted into one of either the open proximate end or the open distal end, for combined synchronous rotation of the driver and the locking core within the elongated bore. The driver engages the arcuate track for rotation within the modified rotational displacement.

a riser pivots from the driver to interact with the locking core when the locking core is inserted into the elongated bore for coordinated movement between a first position and a second position. In this aspect, the riser is in the first position when the locking core is operable with a change key. When the riser is in the second position, the riser is operable with an operating key. The riser engages the locking core as the driver rotates within the modified rotational displacement, to allow the locking core to rotate about the horizontal axis within the modified rotational displacement.

In the preferred embodiment, the riser is in the first position when the locking core is in the unlocked position. However, in some embodiments, the locking apparatus may be configured, with suitable modifications, so that the riser is in the first position when the locking core is in the locked position.

Preferably, when the riser is in a third position, a change key may be used to withdraw the locking core and the driver from the housing. In other embodiments, when a suitably configured riser is in the third position, the locking core may be withdrawn separately from the driver, if desired.

In some embodiments, the invention provides locking systems and storage structures which include variations of the locking apparatuses of the invention. Many other possible variations and modifications are also possible and will become apparent upon reading this specification.

IN THE DRAWINGS

DETAILED DESCRIPTION OF A PREFERRED EMBODIMENT

Figure 1:
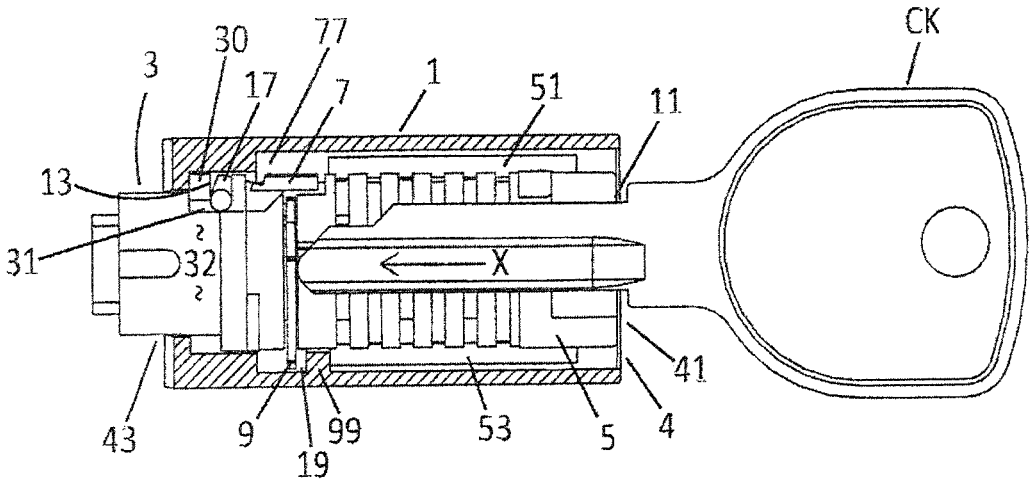
FIG. 1 is a sectional side view of a preferred embodiment of a locking apparatus of the present invention, with an installed locking core in which a change key is partially inserted into the keyway of the locking core when the locking core is in the unlocked position.

FIGS. 1 to 6 and FIGS. 3A and 5A illustrate a first embodiment of the invention. A housing 1 is provided with an elongated bore 4 which extends along a longitudinal axis between a proximate open end 41 and a distal open end 43. A driver 3 is configured to slide-fit for synchronous rotation with a cylindrical locking core 5 within bore 4. The driver 3 partially extends outwardly from distal open end 43. The driver 3 is provided with a spacer 30 having a first spacer shoulder 31 and a second spacer shoulder 33 opposite from the first spacer shoulder 31. A driver recess 32 is defined between opposing spacer shoulders 31,33. The spacer 30 acts as a follower in a track 15. In this embodiment, the track 15 defines an extended rotational displacement range along an arcuate path for spacer 30.

Although in this example, a spacer 30 is illustrated as a follower within track 15, other configurations and designs are possible for these elements. For example, variations are possible to provide changes to the rotational displacement range, such as, but not limited to, increasing the rotational range from 90 degrees to 180 degrees or from 90 degrees to 270 degrees. Also, the driver 3 and track 15 may be configured to provide for left-turn and/or right turn configurations. Persons skilled in the art will appreciate that other configurations and variations will be possible with this invention, including those instances where it is intended to retrofit a locking apparatus of this invention into existing cabinets, lockers, office furniture or other structures which may include compatible locking systems and/or locking cores.

In some adaptations, both the driver 3 and the track 15 may be reconfigured, and in other instances, particularly where the invention is applied to OEM systems, it may be possible to vary either the driver configuration or the track configuration in the housing, while using other OEM components in the applicable variants.

The illustrated locking core 5 is an example of a commonly used cylindrical locking core provided with a retainer 9 which is designed to travel across the longitudinal axis of the locking core when a centrally positioned slot (not shown) is engaged with a correctly keyed change key CK inserted within keyway 11. Typically, core 5 is configured with a plurality of tumbler slots 55 which are usually fitted with spring biased tumblers (not shown) for engagement with upper and lower tumbler recesses 51, 53 defined in housing 1.

In this embodiment, driver 3 is configured with a profile similar to locking core 5, relative to the longitudinal axis, so that both components may be inserted into the bore 4 through proximate open end 41. In some instances, the locking core 5 and driver 3 may be slide-fit outside of the housing for releasable engagement, so that the components may be inserted simultaneously into the bore 4. The core 5 and the driver 3 are configured for simultaneous rotation within the bore 4. In this embodiment, core 5 is provided with a predefined rotational displacement defined by core recess 50, bounded by core recess wall 52, having a 90 degree rotational limit, which is a feature used in known locking systems.

FIGS. 1 to 3 and 3A illustrate the progress of change key CK as it is inserted into keyway 11 in the direction shown by arrow X. In FIG. 1, the leading tip of change key CK approaches retainer 9 while the lower tip of retainer 9 is positioned within retainer channel 19 bounded by retainer barrier wall 99. The illustrated locking apparatus is shown in an unlocked position. In this position, the riser 7 is illustrated in a first position in which the locking core 5 and the driver 3 are prevented from withdrawal from the housing 1 by retainer barrier wall 99. Retainer barrier wall 99 functions as a longitudinal barrier acting against the lower tip of retainer 9, to prevent withdrawal of locking core and the driver, along longitudinal axis.

Figure 2:
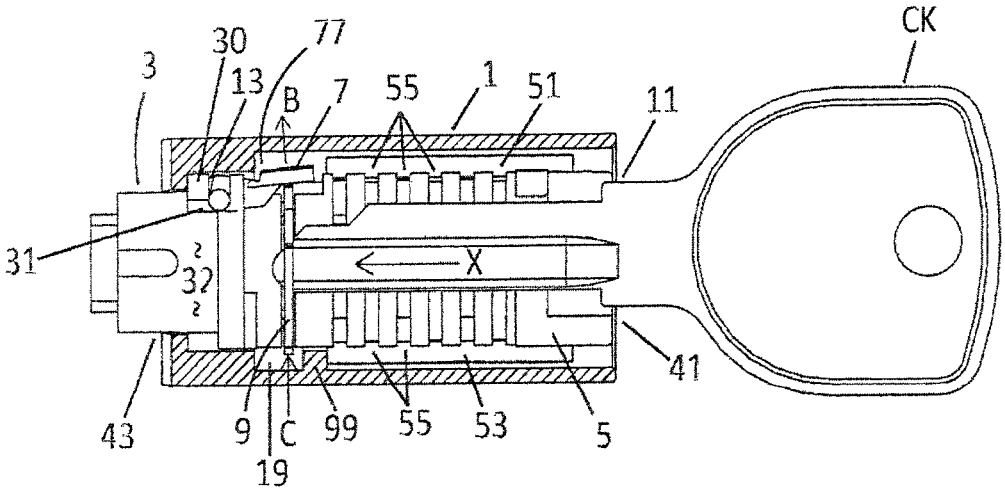
FIG. 2 is a sectional side view of the preferred embodiment shown in FIG. 1 in which the change key is further inserted into the keyway.
Figure 3:
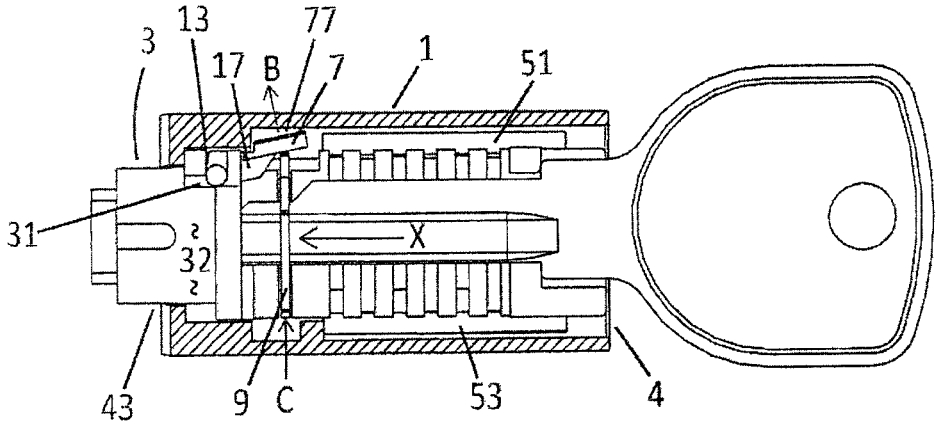
FIG. 3 is a sectional side view of the preferred embodiment of FIG. 1 in which the change key is fully inserted into the keyway.
Figure 3A:
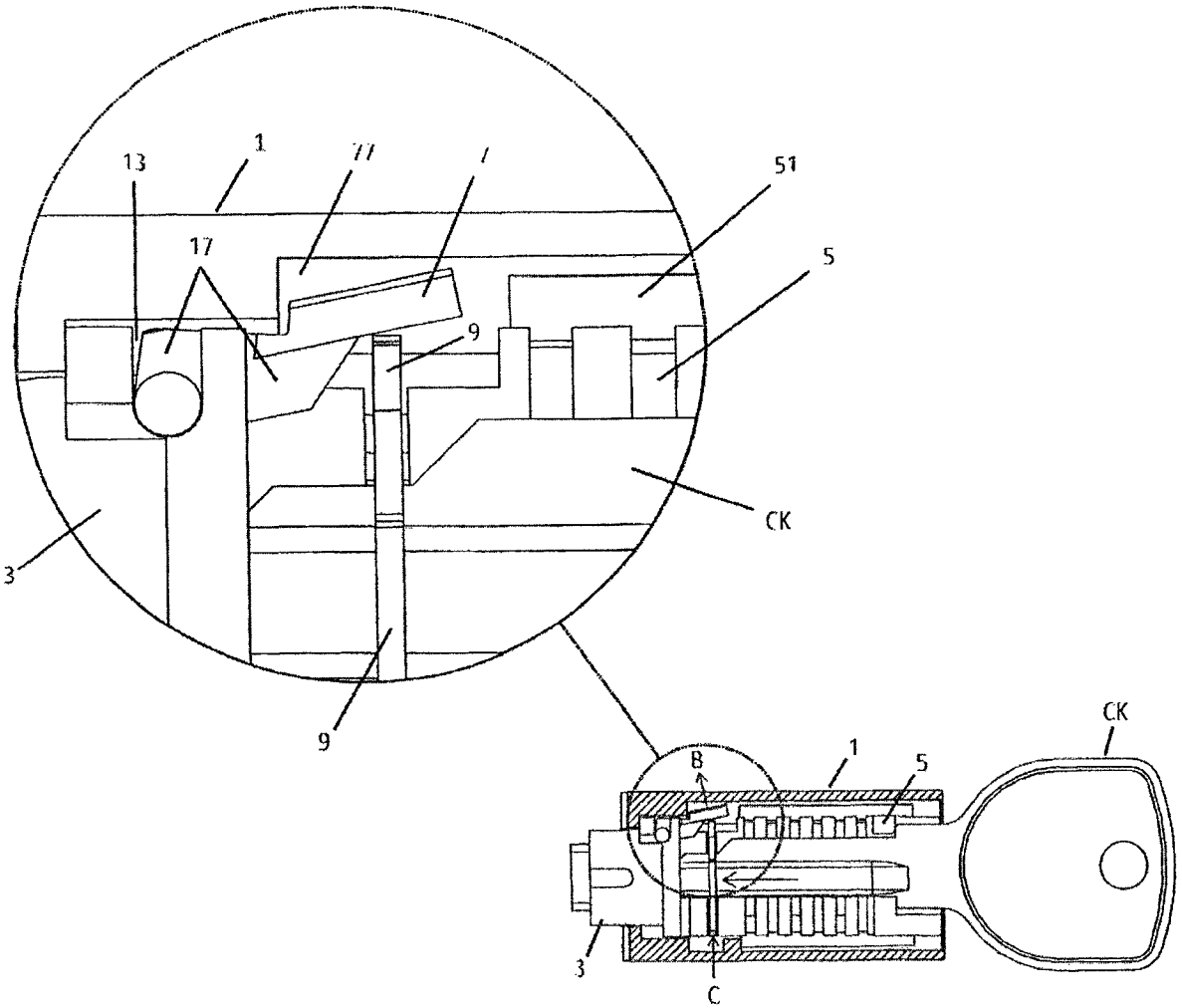
FIG. 3A is a partial, enlarged sectional side view of the preferred embodiment of FIG. 1 showing a portion of the distal end of the locking core in operational engagement with the driver.
Figure 5:
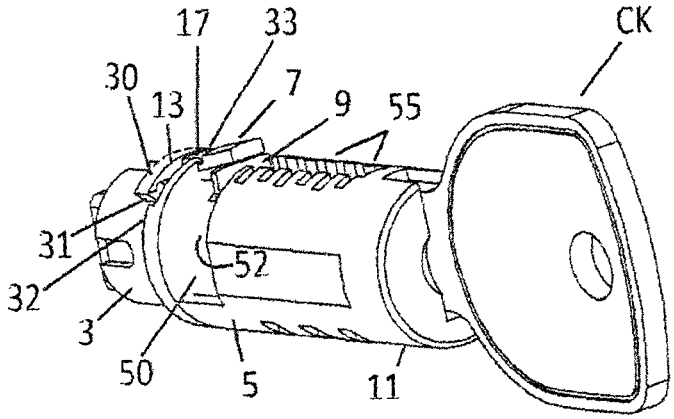
FIG. 5 is a side view in perspective of the preferred embodiment of FIG. 1, without the housing, in which the operating key has been fully inserted.
Figure 6:
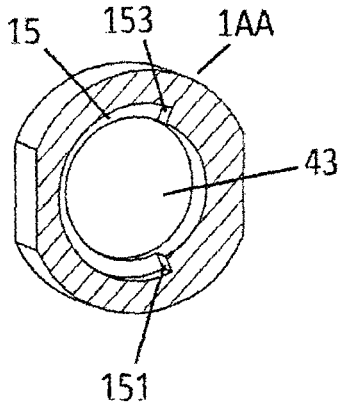
FIG. 6 is a sectional interior view in perspective of the cross section along lines A-A of the housing of the embodiment as shown in FIG. 12.

With reference to FIG. 2, as the tip of change key CK engages a keyway slot segment (not shown) defined by the retainer 9, the retainer 9 rises (as shown by arrow C) to engage a distal portion of pivoting riser 7 having a riser arm 17 cradled in slide-fit within port 13 in driver 3. The upward movement of retainer 9 in turn causes upward movement of riser 7 as shown by arrow B. When the change key CK is fully inserted as shown in FIGS. 3, 3A and 5, the riser 7 is illustrated in a third position in which the riser 7 is fully extended into riser channel 77 which extends along the longitudinal axis to open end 41 of the bore 4. When the change key CK is fully inserted, the tumblers (not shown) and the retainer 9 are retracted so that the locking core 5 and the driver 3 may be withdrawn from the bore 4 along with the change key CK.

Figure 4:
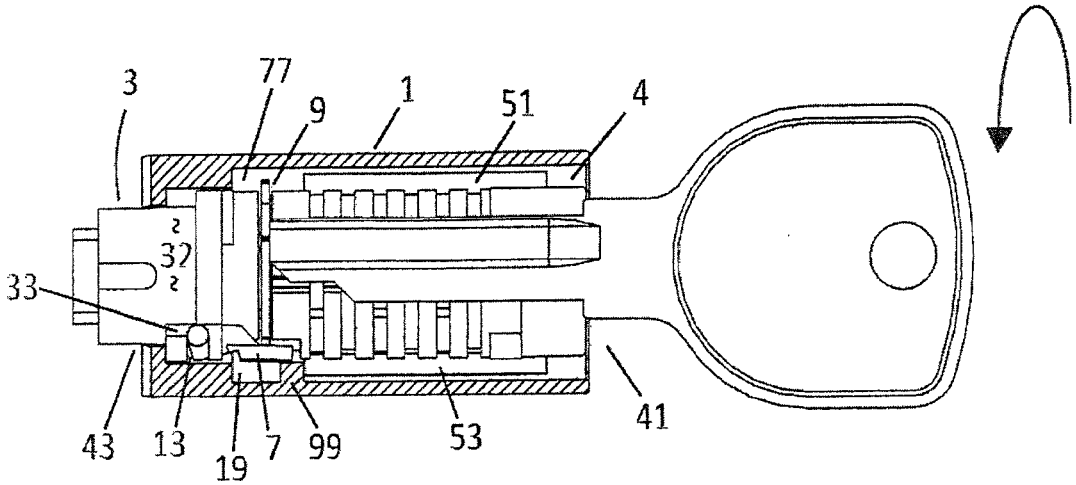
FIG. 4 is a sectional side view of the preferred embodiment in which the locking core has been rotated 180 degrees to a locked position, in which the change key is partially inserted into the keyway.

In FIG. 4, the locking core 5 and driver 3 of the preferred embodiment are shown in a locked position, and the riser 7 is illustrated in a second position in which the locking core is rotatable; with the retainer 9 in its corresponding position, from which the locking core 5 and the driver 3 may be rotated back to the unlocked position (illustrated in FIGS. 1 to 3 and 3A) with an operating key (not shown). FIG. 4 illustrates an unsuccessful attempt to introduce a change key CK into the keyway. However, the CK key is blocked against entry (and withdrawal of the locking core and driver from this position) by the misaligned keyway slot segment (not shown) defined by the retainer 9.

In FIG. 4, the riser 7 is shown abutting against the upper limit of retainer wall 99, as the riser 7, in its second position, travels between the locked position and the unlocked position. While the riser 7 travels in this position upon operation by the operating key OK (which is not shown), the riser 7 urges the opposite edge of the retainer 9 to travel within the retainer channel 19, to prevent withdrawal of the locking core and the driver. In this embodiment, only the operating key OK may be inserted into the keyway while the locking core is in the locked position, to operate the locking core between the locked and unlocked positions.

Figure 5A:
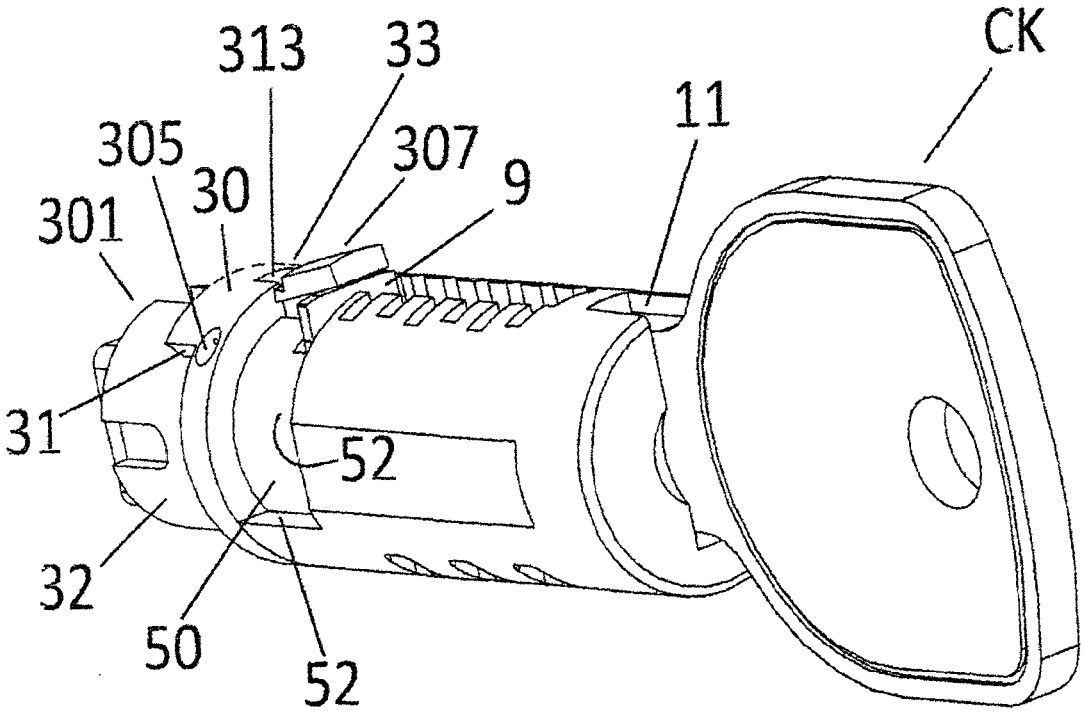
FIG. 5A is side view in perspective of another embodiment of the invention, without the housing.

FIG. 5A illustrates a variant of the driver, 301, in which a modified riser 307 is pivotally mounted within port 313, on a pin (not shown) installed within pivot pin bore 305. It will be appreciated that the riser and corresponding features within the driver may take the form of other configurations and modifications. Although the examples illustrated in these Figures show an example of a riser configured as a pendulum, pivoting about a point or pin within the driver, other configurations are also possible. For example, the riser may be configured as a lever, pin, piston or other configuration capable of reciprocating in a suitable manner to achieve the desired interaction with the core, or the retainer 9 provided in the locking core 5, or other variations of the locking core, retainer and other components.

Figure 9:
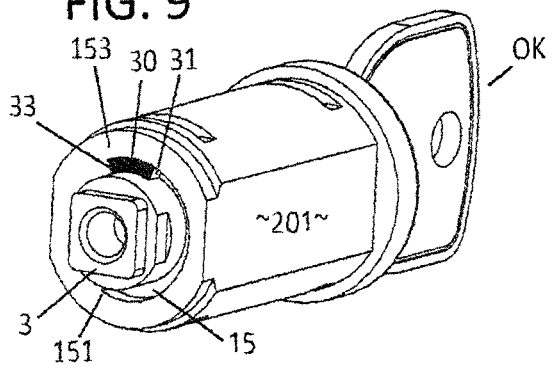
FIG. 9 is an end view in perspective of another embodiment of the invention in which the operating key is inserted in the unlocked position.
Figure 10:
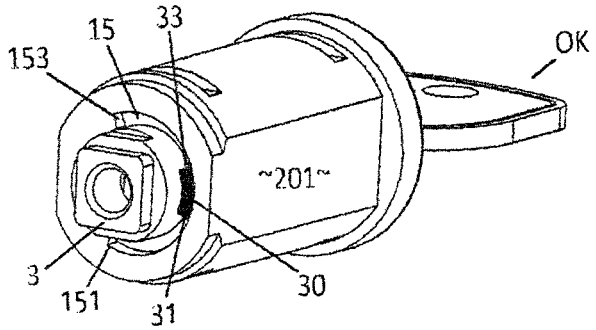
FIG. 10 is an end view in perspective of the embodiment of FIG. 9 in which the operating key is inserted and rotated to the 90 degree (quarter turn) position.
Figure 11:
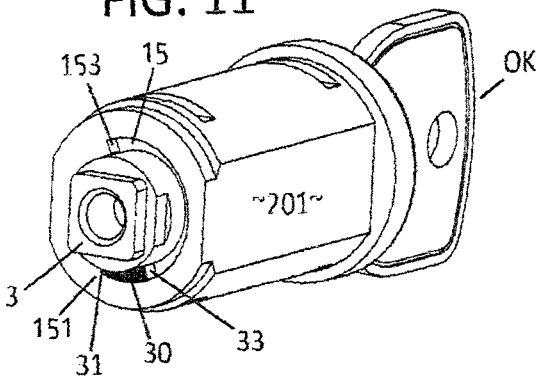
FIG. 11 is an end view in perspective of the embodiment of FIGS. 9 and 10 in which the operating key is inserted and rotated to the 180 degree (half turn) position.
Figure 12:
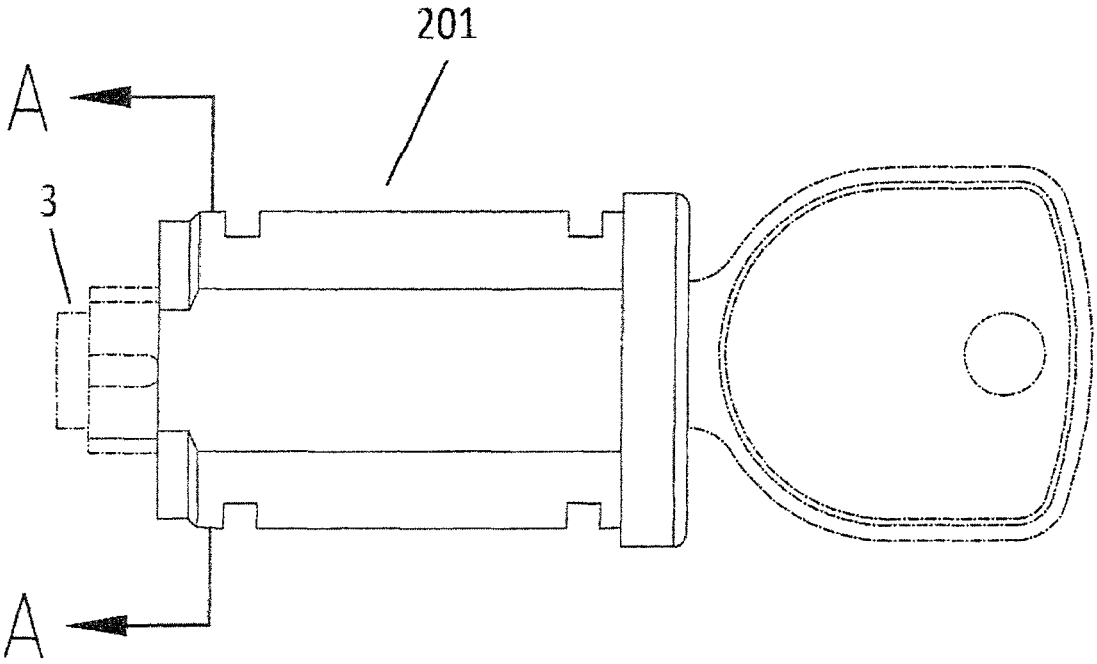
FIG. 12 is a side view of the housing of the embodiment of FIGS. 9 to 11, showing a cross section taken along lines A-A.

FIGS. 9 to 12 illustrate a variation of the housing, 201, showing the distal end of the housing 201 in cross section. FIG. 12 illustrates the cross section of housing 201 taken along section lines A-A, to illustrate the features of the example of track 15 as shown in more detail in FIG. 6. The distal end of the housing 201 is shown as section piece 1AA, in which track 15 is configured as an arcuate path of a length defined by opposing track abutments 151, 153. In FIG. 9, an operating key OK is fully inserted into the keyway while the locking core in this example, is in the unlocked position. In FIG. 10, the operating key OK is rotated 90 degrees, thus displacing the spacer 30 (driver and locking core) a corresponding 90 degrees along track 15. FIG. 11 shows the spacer 30 after a 180 degree rotation, after traveling within the track 15 along an extended rotational displacement range (to a locked position), with the spacer 30 abutting against track abutment 151. In this position, an appropriately configured detent may be provided so that the riser 7 will preferentially retain the locking core and the driver in the locked position, if the operating key OK is withdrawn. The detent and the riser 7 may be suitably configured to ensure that the riser 7 will be urged into its second position when the operating key OK is reinserted for rotational operation along the track, such that the riser 7 may travel unimpeded along the top edge of retainer wall 99, until the locking assembly returns to the unlocked position.

Figure 7:
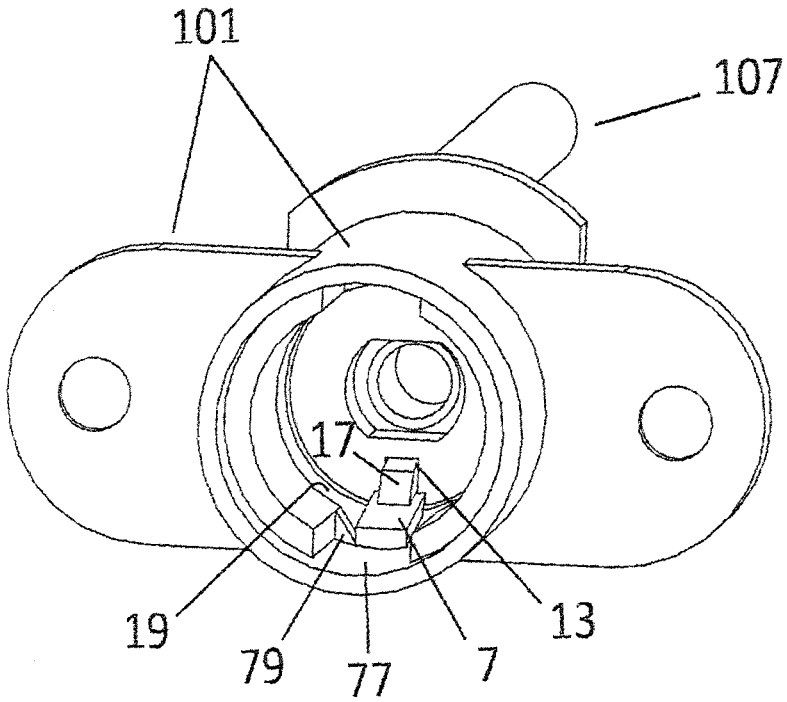
FIG. 7 is a cross sectional end view in perspective of another embodiment of a housing of the present invention, with the change key removed, the driver in position for rotation with an operating key.
Figure 8:
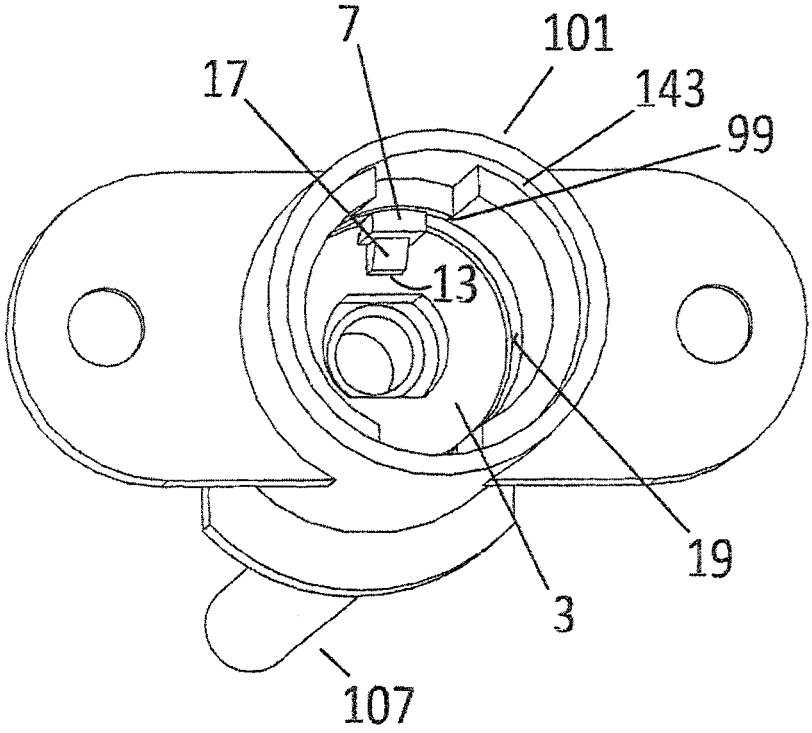
FIG. 8 is another cross sectional end view in perspective of the embodiment shown in FIG. 7, with the driver in the 180 degree (half-turn) rotated position.

FIGS. 7 and 8 illustrate another variant of the housing, 101, in partial section adjacent distal open end 143 of housing 101, including a variant of the driver connected to a cam 107 but excluding a locking core. The housing 101 is featured with opposed mounting flanges and mounting bores to receive suitable fasteners which may be used to secure the locking apparatus to a structure. In FIG. 7, the riser 7 is shown fully extended into the riser channel 77, for example, when the locking core is in the unlocked position. In some instances, it may be necessary or desirable to provide a feature, such as riser ramp 79, to allow the proper repositioning of the riser from its illustrated elevated position to its first position, when rotating the locking core from the unlocked position, so that the riser is moved from its first position, to its second position, in synchronized movement with the retainer as the retainer travels along the retainer channel 19. Other configurations are possible to urge the riser 7 to move out from the riser channel 77 (which, in this example corresponds to a third position), to permit suitable rotational operation of the riser 7, between the first position of the riser and its second position.

The foregoing examples are illustrative of some embodiments of the invention, including preferred embodiments of a locking assembly, some of which may include a new rotating locking core, and a storage structure including a preferred locking apparatus. It will be apparent to those skilled in the art that additional embodiments, modifications and variations are possible and that such embodiments, modifications and variations will fall within the scope of the appended claims.

We claim:

1. A locking apparatus for use with a cylindrical locking core, the locking core defining a keyway along a longitudinal axis and being configured for rotation about the longitudinal axis within a predefined arcuate displacement, the locking apparatus comprising:

a housing to be secured against movement within a storage structure, the housing defining an elongated bore extending along the longitudinal axis between a proximate open end and a distal open end;

the distal open end of the bore comprising an arcuate track defining a rotationally modified arcuate displacement about the longitudinal axis different from the predefined arcuate displacement;

a riser for radial movement perpendicular to the longitudinal axis, between a first position and a second position;

a driver configured for releasable engagement with the locking core, the driver and the locking core being configured for insertion into one open end of the elongated bore, for combined synchronous rotation of the driver and the locking core within the elongated bore, the driver defining a follower for travel within the arcuate track;

the riser being in the first position when the locking core is operable with a change key; and the riser being in the second position when the locking core is operable with an operating key, the riser operatively engaging the locking core to allow the driver to rotate about the horizontal axis within the rotationally modified arcuate displacement.

2. In the locking apparatus claimed in claim 1, the rotationally modified arcuate displacement is selected from the group consisting of: (i) an arcuate displacement which is less than the predefined arcuate displacement, (ii) an arcuate displacement which is more than the predefined arcuate displacement, (iii) an arcuate displacement which is changed from a clockwise to a counterclockwise direction, and (iv) an arcuate displacement which is changed from a counterclockwise to a clockwise direction.

3. In the locking apparatus claimed in claim 2, the riser is selected from the group consisting of a pendulum, a lever, a pin, and a piston.

4. The locking apparatus claimed in claim 2 comprising the locking core, the locking core comprising a retainer moving in abutting relation with the riser between:

the first position when the follower is adjacent a first stop defined by the arcuate track, and the second position when the follower is adjacent a second stop defined by the arcuate track, as the retainer travels across the rotationally modified arcuate displacement.

5. In the locking apparatus claimed in claim 1, when in use the riser being in a third position allowing insertion of the locking core into the housing or withdrawal of the locking core from the housing.

6. In the locking apparatus claimed in claim 5, the riser is biased to return to the first position.

7. In the locking apparatus claimed in claim 1, the riser being configured to interact with a retainer in the locking core for radial movement of the retainer relative to the longitudinal axis between the first position and the second position, the retainer defining an opening for operational alignment with the keyway upon insertion of a key into the keyway.

8. In the locking apparatus claimed in claim 1, when in use the riser is received in the driver to engage a retainer in the locking core when the locking core and the driver are inserted within the elongated bore, the retainer reciprocating between: the first position when the locking core is in the unlocked position, and the second position when the locking core is in the locked position.

9. In the locking apparatus claimed in claim 1, the driver and the locking core are configured for releasable assembly outside of the housing for combined insertion into the elongated bore, the riser extending from the driver to abut against a retainer in the locking core, the retainer reciprocating radially between engagement with a retainer channel defined by the housing and disengagement with the housing upon movement of the riser between a third position and the first position.

10. A storage structure comprising the locking apparatus claimed in claim 9, the riser being configured as a pendulum extending from a pivot within a port defined by the driver to a distal projection abutting against the retainer.

11. In the locking apparatus claimed in claim 1 comprising the locking core when in use, the driver and the locking core are configured for insertion into the elongated bore through the proximate open end.

12. A storage structure comprising the locking apparatus claimed in claim 1, wherein the locking apparatus comprises the locking core, the locking core comprising a retainer moving in abutting relation with the riser between:

the first position when the retainer is adjacent a first stop defined by the arcuate track, and the second position when the retainer is adjacent a second stop defined by the arcuate track, as the retainer travels across the rotationally modified arcuate displacement.

13. In the locking apparatus claimed in claim 1, the predefined arcuate displacement is 90 degrees and the rotationally modified arcuate displacement is between 180 degrees and 270 degrees.

14. In the locking apparatus claimed in claim 13, the rotationally modified arcuate displacement is 180 degrees or 270 degrees.

15. A locking apparatus comprising:

a cylindrical locking core, the locking core defining a keyway along a longitudinal axis, configured for rotation within a predefined arcuate displacement about the longitudinal axis by an operating key inserted into the keyway;

a housing defining a longitudinal elongated bore extending between a proximate open end and a distal open end;

the distal open end of the bore comprising an arcuate track defining a rotationally modified arcuate displacement about the longitudinal axis different from the predefined arcuate displacement, the rotationally modified arcuate displacement extending between a first stop and a second stop;

a driver releasably connecting to the locking core, the driver and the locking core being configured for insertion into the proximate open end of the elongated bore, for combined synchronous rotation of the driver and the locking core within the elongated bore, the driver comprising a follower travelling within the arcuate track;

a riser extending in pivoting relation from the driver to engage a retainer within the locking core, for cooperating perpendicular movement of the riser and the retainer relative to the longitudinal axis, between a first position and a second position;

the riser being in the first position when the locking core is in position for rotational movement relative to the housing and the retainer is adjacent the first stop; and the riser being in the second position when the follower is within the rotationally modified arcuate displacement, to allow the locking core to rotate about the horizontal axis within the rotationally modified arcuate displacement.

16. The locking apparatus claimed in claim 15, wherein the follower travels within the arcuate track between the first stop when the locking core is locked and the second stop when the locking core is unlocked and rotatably displaced by the operating key.

17. The locking apparatus claimed in claim 15, wherein the riser urges the displacement of the retainer across the longitudinal axis for rotationally modified arcuate displacement of the follower within the arcuate track.

18. A storage structure comprising the locking apparatus claimed in claim 17, the riser being configured as a pendulum pivotally extending from the driver to a distal projection abutting against the retainer.

19. A storage structure comprising the locking apparatus claimed in claim 15, the riser extending from a pivot within a port defined by the driver to a distal projection abutting against the retainer.

20. In the locking apparatus claimed in claim 15, the predefined arcuate displacement is 90 degrees and the rotationally modified arcuate displacement is between 180 degrees and 270 degrees.

21. In the locking apparatus claimed in claim 20, the rotationally modified arcuate displacement is 180 degrees or 270 degrees.

22. A locking apparatus for use with an insertable cylindrical locking core, the insertable locking core being configured for rotation when in use about a longitudinal axis within a predefined arcuate displacement, the locking apparatus comprising:

a housing for fixed non-rotating installation within a storage structure, the housing defining a longitudinal elongated bore extending between a proximate open end and a distal open end;

the housing defining an arcuate track adjacent the distal open end of the bore, the arcuate track defining a rotationally modified arcuate displacement of the locking core different from the predefined arcuate displacement;

the rotationally modified arcuate displacement is selected from the group consisting of: (i) an arcuate displacement which is less than the predetermined arcuate displacement, (ii) an arcuate displacement which is more than the predefined arcuate displacement, (iii) an arcuate displacement which is changed from a clockwise to a counterclockwise direction, and (iv) an arcuate displacement which is changed from a counterclockwise to a clockwise direction;

a driver configured for releasable engagement with the locking core, when the locking core is inserted into one of either the open proximate end or the open distal end, for combined synchronous rotation of the driver and the locking core within the elongated bore, the driver engaging the arcuate track for rotation within the rotationally modified arcuate displacement;

a riser extending in pivoting relation from the driver to the locking core when the locking core is inserted into the elongated bore for perpendicular movement of the riser relative to the longitudinal axis, between a first position and a second position;

the riser being in the first position when the locking core is in position for rotational movement relative to the housing; and when the riser is in the second position, the riser operatively engages the locking core as the driver is rotating within the rotationally modified arcuate displacement, to allow the locking core to rotate about the horizontal axis within the rotationally modified arcuate displacement.

23. The locking apparatus claimed in claim 22, wherein the riser is configured as a pendulum mounted within a port defined by the driver, and the riser operatively engages a retainer within the locking core, the retainer reciprocating across the longitudinal axis for selective engagement with a retainer channel defined by the housing.

24. The locking apparatus claimed in claim 23 comprising the locking core, the retainer defining an opening for selective alignment with the keyway when a change key is inserted into the keyway, the riser urging the retainer to disengage from a retainer channel to permit withdrawal of the locking core and driver from the housing.

25. A storage structure comprising the locking apparatus claimed in claim 23 wherein the riser abuts against the retainer to urge the retainer to travel within a retainer channel extending across the elongated bore.

26. The storage structure claimed in claim 25, wherein the retainer travels within a first portion of the retainer channel when the locking core is rotated from a first stop within the predefined arcuate displacement and the retainer travels within a second portion of the retainer channel when the locking core is rotated to a second stop within the rotationally modified arcuate displacement.

27. In the locking apparatus claimed in claim 22, the predefined arcuate displacement is 90 degrees and the rotationally modified arcuate displacement is between 180 degrees and 270 degrees.

28. In the locking apparatus claimed in claim 27, the rotationally modified arcuate displacement is 180 degrees or 270 degrees.

29. A locking apparatus comprising:

a housing adapted to be fixed within a structure, the housing defining an elongated bore extending along a longitudinal axis, between a first open end and a second open end, one of the first and second ends defining a track;

a driver comprising a follower traveling within the track, within a rotationally modified arcuate displacement defined by the follower traveling within the track; and a locking core having a configuration for a predefined arcuate displacement which is different from the rotationally modified arcuate displacement, the locking core being insertable into the elongated bore for releasable engagement and synchronized rotation with the driver within the rotationally modified arcuate displacement; and when in use, a riser extending from the driver and interacting with a reciprocating retainer in the locking core to inhibit unauthorized withdrawal of the locking core from the housing, the riser moving between a first radial position for operation within the predefined arcuate displacement to a second radial position for operation within the rotationally modified arcuate displacement.

30. The locking apparatus claimed in claim 29 wherein the locking core and the driver are configured to be inserted into one of the open ends of the elongated bore.

31. The locking apparatus claimed in claim 29 wherein the riser urges the retainer to travel within a retainer channel defined by the housing when the locking core is rotated between a locked position and an unlocked position.

32. In the locking apparatus claimed in claim 29, the predefined arcuate displacement is 90 degrees and the rotationally modified arcuate displacement is between 180 degrees and 270 degrees.

33. In the locking apparatus claimed in claim 32, the rotationally modified arcuate displacement is 180 degrees or 270 degrees.

34. In the locking apparatus claimed in claim 29, the predefined arcuate displacement is: (i) between 180 degrees and 270 degrees and the rotationally modified arcuate displacement is 90 degrees;

(ii) 180 degrees and the rotationally modified arcuate displacement is 90 degrees;

or (iii) 270 degrees and the rotationally modified arcuate displacement is between 90 degrees and 180 degrees.

* * * * *